US005411161A

United States Patent [19]

Fish, Jr.

[11] Patent Number: 5,411,161

[45] Date of Patent: May 2, 1995

[54] CONTAINER HAVING A TWIST-LOCKING COVER

[76] Inventor: Milton L. Fish, Jr., 1145 Oak Ridge Dr., Glencoe, Ill. 60022

[21] Appl. No.: 293,357

[22] Filed: Aug. 19, 1994

[51] Int. Cl.[6] ..... B65D 41/06

[52] U.S. Cl. ..... 220/293; 220/301; 220/318; 220/908

[58] Field of Search ..... 220/212.5, 281, 293, 220/301, 351, 908, 318; 215/218, 222, 223, 330, 331, 339, 340

[56] References Cited

U.S. PATENT DOCUMENTS

| | | | |
|---|---|---|---|
| 890,302 | 6/1908 | Roediger | 215/340 X |
| 2,964,207 | 12/1960 | Towns . | |
| 2,987,226 | 6/1961 | Bane | 220/293 X |
| 3,155,259 | 11/1964 | Scheurman | 215/223 |
| 3,204,800 | 9/1965 | Bugla et al. | 215/223 |
| 3,703,974 | 11/1972 | Boxer et al. . | |
| 3,860,133 | 1/1975 | Boxer et al. | 215/206 |
| 3,900,106 | 8/1975 | Cantales . | |
| 3,901,401 | 8/1975 | Lynn et al. . | |
| 4,202,574 | 5/1980 | Redmayne . | |
| 4,214,782 | 7/1980 | Boyer . | |
| 4,320,851 | 3/1982 | Montoya . | |
| 4,375,859 | 3/1983 | Fillmore . | |
| 4,390,110 | 6/1983 | Pirro . | |
| 4,399,920 | 8/1983 | Swartzbaugh et al. . | |
| 4,434,903 | 3/1984 | Cooke . | |
| 4,473,170 | 9/1984 | Ciancimino | 220/300 |
| 4,723,686 | 2/1988 | Pennisi | 220/300 |
| 4,863,053 | 9/1989 | Oberg . | |
| 5,050,762 | 9/1991 | Giorgi . | |
| 5,082,132 | 1/1992 | Tsai . | |
| 5,085,340 | 2/1992 | Doxey et al. . | |
| 5,103,994 | 4/1992 | Doxey et al. . | |
| 5,118,144 | 6/1992 | Garofalo, Jr. . | |

FOREIGN PATENT DOCUMENTS

| | | |
|---|---|---|
| 1058598 | 11/1955 | France . |
| 1157505 | 5/1958 | France . |
| 196914 | 5/1924 | United Kingdom . |
| 1515266 | 6/1978 | United Kingdom . |

*Primary Examiner*—Allan N. Shoap
*Assistant Examiner*—Vanessa Caretto
*Attorney, Agent, or Firm*—Jenner & Block

[57] ABSTRACT

A refuse device includes a cover which can be locked to the container of the device by rotating the cover on the container. The cover includes a top portion, a collar extending downwardly from the top portion, and two tabs attached to the collar, spaced apart from the top portion, located opposite each other, and extending inwardly from the collar. The container includes a sidewall terminating in an upper edge, a closed bottom attached to the sidewall opposite the upper edge, an outwardly extending rim attached to the upper edge of the sidewall, and an upwardly extending lip attached to the rim opposite the sidewall. The lip includes two diametrically opposite channels through which the tabs move when the cover is placed on or removed from the container. The lip also includes six groove, two of which flank the first channel, two of which flank the second channel, and two of which are positioned intermediate the first and second channels. The latches rest within the two intermediate groove when the cover is first placed on the container. The latches rest in two of the grooves flanking the channels when the cover is locked to the container. In this locked position, the cover cannot be lifted from the container, and resists rotation on the container.

13 Claims, 5 Drawing Sheets 74
26
34
22
28
70
32
76
68
60
47
42B
44
56
50
58
D1
64
C1
42
24
52
48
42A
54
62
B1
66
A1
46
A2
D2
40
C2
36
B2

32
76
30
22
68
72
70
74
42
42B
47
60
56
50
58
D1
64
42A
C1
24
44
52
62
54
48
66
B1
A1
A2
D2
40
C2
36
46
B2

CONTAINER HAVING A TWIST-LOCKING COVER

The present invention relates generally to any container, and more particularly, to a refuse container having a cover which can be easily rotated along the lip of the container for locking or unlocking the container.

BACKGROUND OF THE INVENTION

Garbage or refuse containers which are susceptible to being opened by either animals or small children present many well known problems. For example, if an animal such as a raccoon is able to open a closed garbage container, the animal most likely will scavenge through the refuse, creating an unsightly and unsanitary mess. Similarly, if small children are able to open closed garbage containers, the children may come in contact with potentially dangerous objects, such as broken glass or sharp metal objects, in addition to creating a mess. Moreover, the open container then becomes an easy target for scavenging animals.

There have been numerous attempts to overcome these and other problems by providing garbage cans with locking or securable covers. These attempts, however, have met with limited success. For example, U.S. Pat. No. 4,202,574 discloses clips which secure the cover to the main container of the garbage can. The clips extend beyond the collar of the cover and engage the upper lip of the container, thereby securing the cover to the container. The cover is removed by pushing on a lever portion of the clip to rotate the clip past the lip of the container. Also, U.S. Pat. No. 5,118,144 discloses removable clips which are attached to the rim of a garbage can so that they can be snapped over the rim of the garbage can lid to secure the lid to the garbage can. However, the clips can be disengaged inadvertently when, for example, the garbage can is pushed over on its side. Thus, scavengers and small children can still gain access to the refuse within the garbage can. Also, because the clips require some resiliency to operate, the clips may malfunction or break in extremely cold weather or from abuse to the exterior of the container. In addition, the clips can become separated from the garbage can because they are not an integral part of the garbage can or cover. As a result, the clips can be lost or misplaced.

U.S. Pat. No. 4,320,851 discloses draw-bolt type latches located on the top surface of the cover for securing the cover to the container of the garbage can. The latches cooperate with a pair of loops attached to the container which extend through openings in the cover. The latches can be manipulated by some animals, such as raccoons, and thus do not always prevent animals from scavenging the refuse within such garbage cans.

U.S. Pat. No. 4,214,782 discloses a releasable latch for securing a cover to the container of a garbage can. The latch is located on the collar of the cover and cooperates with a stop member located on the opposite side of the collar. The latch includes a tab which extends inwardly through an opening in the collar of the cover and engages the bottom of the upper rim of the garbage can, thereby securing the cover to the main container. The latch is released by pulling on a resilient arm which forms a part of the latch. However, this latch suffers from several disadvantages. For example, opening the garbage can requires at least two steps and possibly the use of two hands. Moreover, because the latch is released by pulling on a resilient arm, the latch also may malfunction or break in extremely cold weather.

U.S. Pat. Nos. 4,390,110, 5,103,994, and 5,050,762 disclose tongue-in-groove or rim-in-groove mechanisms for securing a cover to the main container. In U.S. Pat. No. 4,390,110 the down-turned collar of the cover interlocks with a groove or slot located between two vertical walls extending outwardly from the side of the garbage can. The collar of the cover in U.S. Pat. No. 5,103,994 contains an inwardly depending rim which cooperates with a groove located along the outside perimeter of the open top of the garbage can. The handle assembly includes lobe projections to further secure the collar rim within the body groove. In U.S. Pat. No. 5,050,762, a tongue protrudes outwardly from the upper sides of the garbage can and extends through an opening in the collar of the cover to secure the cover to the garbage can.

The aforementioned devices all suffer certain disadvantages. First, unlocking and opening the garbage cans requires the use of two hands and/or several steps. Second, the locking mechanism in each of these devices requires some resiliency to operate. Hence, the locking mechanisms may malfunction in extremely cold weather. Moreover, the locking mechanisms may disengage inadvertently when, for example, the garbage containers are tipped over or otherwise disturbed.

U.S. Pat. Nos. 4,863,053 and 5,082,132 disclose garbage cans with locked covers which appear to prevent scavenging by animals. However, the covers are so securely locked to the garbage cans that removing the covers to place refuse within the garbage cans or to empty the cans can be cumbersome. U.S. Pat. No. 4,863,053 discloses a cover secured to the can by a spring-loaded lever arm located inside the main container of the garbage can. The lever arm is released by applying force to a pressure pad on the outside of the garbage can. As much as 200 pounds of force is required to unlatch the lever arm, thus making it extremely difficult for some individuals to open the cover. U.S. Pat. No. 5,082,132 discloses a twin-barrel garbage can in which the two covers are suspended from a cross-bar. The covers have elongated collars containing openings for depositing refuse into the cans. When the covers sit on the top of the barrels, these openings are blocked by the barrels themselves. To place refuse into the cans, the covers must be raised, either by a piston mechanism or by a lever mechanism, to raise the openings above the sides of the barrels. When the garbage cans are to be emptied, the covers must first be raised above the barrels. Then, a stop lever is used to hold the covers above the barrels. Finally, either the barrels are moved from below the covers or the covers are rotated out of the way to provide access to the interior of the barrels. Thus, emptying these garbage cans requires several steps making the cans difficult to use. Moreover, because the locking mechanisms in U.S. Pat. Nos. 4,863,053 and 5,082,132 use several mechanical components, these garbage cans can be expensive to manufacture and are more susceptible of malfunctioning.

The above-described devices thus do not provide garbage cans which prevent scavenging of refuse by animals and accidental opening by small children while also being easily opened or closed by humans. Moreover, the above containers may be difficult for the elderly or infirm to use. A need, therefore, exists for an animal-proof, user-friendly garbage can.

SUMMARY OF THE INVENTION

It is an object of this invention to provide a refuse device having a locking cover which can be easily operated by humans while preventing refuse scavenging by animals.

Another object is to provide a refuse device which, while being easily operated by adults, prevents accidental opening by small children.

Another object of the invention is to provide a refuse device having a locking cover in which the locking mechanism cannot be easily opened by scavenging animals such as raccoons.

A further object of this invention is to provide a refuse device with a locking cover that can be easily unlocked and removed from the container in a minimum of steps.

Another object of this invention is to provide a refuse device having a locking cover in which the locking mechanism is not separate from the cover or the can and therefore cannot become disassociated from the cover and refuse device and misplaced or lost.

A further object of this invention is to provide a refuse device having a locking cover in which the locking mechanism does not become disengaged if the refuse device is tipped over.

Another object of this invention is to provide a refuse device having a locking cover in which the locking mechanism operates in any extreme climate.

Another object of this invention is to provide a refuse device having a locking cover in which the locking mechanism can be cost effectively produced with minimal mechanical components.

In keeping with these objectives, a refuse device is provided with a cover which is locked to the main container by aligning the cover with the main container, lowering the cover onto the container and rotating the cover along an upper lip of the container. The cover includes a top portion, a downwardly depending collar attached to the top portion and at least two tabs attached to the collar opposite each other, spaced apart from the top portion, and extending inwardly from the collar. The container includes a sidewall attached to a closed bottom, a rim attached to the upper edge of the sidewall, and an upwardly extending lip attached to the rim opposite the sidewall. The lip includes at least two channels located opposite each other, which extend inwardly toward the sidewall. The cover is placed on the container by aligning the tabs with the channels and then lowering the tabs through the channels until the tabs are located directly below the channels. Thereafter, rotating the cover along the lip places the tabs below the rim, thereby securing the cover to the container. Thus, once the cover is properly aligned with and lowered onto the container, it is rotatably moveable between a first, removable position in which the tabs are aligned directly below the channels, and a second, non-removable position in which the tabs are positioned below portions of the rim. The cover can be removed when it is placed in the first position so that the tabs are again aligned directly below the channels. Then the tabs are raised through the channels until they are positioned above the channels.

In a refinement of the invention, the cover also includes at least one latch located on the inner face of the top portion adjacent the collar, spaced apart from the tab, and extending inwardly from the collar along the inner face. The container also includes two groove formed in the upper edge of the lip. The first groove is located adjacent the first channel. The second groove is located adjacent the second channel and is positioned between the first groove and the second channel. In this embodiment, the cover is rotatably moveable among a first, removable position, a second, non-removable position in which the cover is rotatable on the container, and a third locked position in which the cover resists rotation on the container. The cover is placed in the first, removable position by aligning the tabs with the channels and then lowering the tabs through the channels until the tabs are positioned directly below the channels. The cover is then rotated either clockwise or counterclockwise on the container to the second, non-removable position such that the tabs move from below the channels to opposed positions below the rim. In this configuration, the cover is secured to the container and cannot be removed from the container because the rim obstructs the upward motion of the tabs. The cover is then further rotated to the third, locked position in which the latch is positioned within either the first or second groove. For example, once the cover is positioned such that the tabs are aligned with and directly below the channels, the cover is rotated clockwise until the latch rests in the second groove. Alternatively, the cover is rotated counterclockwise until the latch rests in the first groove. When the latch rests in either the first or second groove, the cover is locked to the container, cannot be removed from the container because the rim obstructs the upward motion of the tabs, and resists rotation on the container because the first or second groove obstructs the lateral movement of the latch.

In accordance with a further aspect of the invention, the body can include a third groove located along the upper edge of the lip intermediate the first and second groove. When the cover is in the first, removable position, the tabs are positioned directly below the channels and the latch is positioned within the third groove. Rotating the cover to the second, non-removable position then places the latch along the upper edge of the lip and places the tabs below portions of the rim. The cover can also be rotated to the third, locked position in which the latch is positioned within one of the first or second groove and the tabs are positioned below portions of the rim.

In accordance with another aspect of the invention, the container can also include fourth and fifth groove in the upper edge of the lip. The fourth groove is located adjacent the first channel and located on a side of the first channel opposite the first groove. The fifth groove is adjacent the second channel and positioned between the fourth groove and the second channel. In addition, the container can include a sixth groove intermediate the fourth and fifth groove and diametrically opposite the third groove. When the cover is in the first, removable position the tabs are positioned directly below the channels and the latch is located within either the third or sixth groove. Rotating the cover on the container to the second, non-removable position then places the tabs below the rim and the latch along the upper edge of the lip. In this configuration, the cover cannot be lifted and removed from the container. Further rotation of the cover to the third, locked position then places the latch within one of the first, second, fourth, or fifth groove, depending on the direction in which the cover is rotated. When the latch rests within one of the first, second, fourth, or fifth groove, the cover is locked to the container, cannot be removed from the container, and resists rotation on the container.

In a further refinement of the invention, the cover includes a second latch located on the inner face of the top portion adjacent the collar and diametrically opposite the first latch. The cover is first placed on the container by aligning the tabs with the channels to position the tabs directly below the channels and to place the first latch in one of the third and sixth groove and the second latch within the other of the third and sixth groove. Rotating the cover on the container to the second, non-removable position then places the tabs below the rim and the first and second latches on opposite portions of the upper edge of the lip. In this configuration the cover cannot be removed from the container because the rim obstructs the upward motion of the tabs. Further rotation of the cover to the third, locked position then places the first latch within one of the first, second, fourth, or fifth groove, depending on the direction in which the cover is rotated, and places the second latch in which ever of the first, second, fourth, and fifth groove is diametrically opposite the position of the first latch. In this configuration, the cover is locked to the container, cannot be removed from the container, and resists rotation on the container.

To unlock and remove the cover from the container, a user first lifts up on the cover to remove the latches from within the first, third, fourth, or sixth groove. Then, the user rotates the cover, either clockwise or counterclockwise (depending on previous user rotating preference) until the tabs are aligned with and positioned directly below the channels. Further lifting of the cover then removes the cover from the container.

In an alternative embodiment of the invention, a refuse device is provided having a cover which includes a top portion having an inner face and an outer face, a downwardly depending collar attached to the top portion and at least two tabs attached to the collar opposite each other, spaced apart from the top portion, and extending inwardly from the collar. In addition, the cover also includes a latch located on the inner face of the top portion adjacent the collar. The latch is spaced apart from the first and second tabs, and extends radially inwardly along the inner face. The container of the device includes a sidewall attached to a closed bottom, a rim attached to the upper edge of the sidewall, and an upwardly extending lip attached to the rim opposite the sidewall. The lip includes at least two channels located opposite each other, which extend inwardly toward the sidewall. In addition, the container also includes four groove located along the upper edge of the lip. The first grooves is positioned adjacent the first channel. The second groove is positioned adjacent the second channel and between the first groove and the second channel. The third groove is positioned adjacent the first channel opposite the first groove and the fourth groove is positioned adjacent the second channel opposite the second groove.

In this embodiment, the cover is rotatably moveable among a first, removable position, a second, non-removable position in which the cover is rotatable on the container, and a third, locked position in which the cover resists rotation on the container. The cover is placed in the first position by aligning the tabs directly above the channels and then lowering the tabs through the channels until they are positioned directly below the channels. In the second, non-removable position, the tabs are positioned below the rim and the latch is positioned along the upper edge of the lip. In the third, locked position the tabs are positioned below the rim and the latch is positioned within one of the first, second, third, and fourth groove. To unlock and remove the cover from the container, a user first lifts up on the cover to remove the latch from within the first, second, third, or fourth groove. Then, the user rotates the cover, either clockwise or counterclockwise (depending on the user's previous rotational preference) until the tabs are aligned with and positioned directly below the channels. Further lifting of the handle removes the cover from the container.

Because the cover is easily locked to the container by rotating the cover to a locked position, the cover can be readily operated by adults and can be unlocked and removed from the container in a minimum of steps. However, the cover is not readily opened by small children and animals thus making a refuse device according to the invention animal proof and child proof. Furthermore, because removing the cover requires rotating the cover until the tabs are placed within the channels, the cover is not readily disengaged from the container even if the device falls or is knocked over. And because the cover is locked to the container by simply rotating the cover to a locked position, the device can be made from either resilient or rigid materials and can be constructed from materials which perform well in extreme climates.

DETAILED DESCRIPTION

Figure 1:
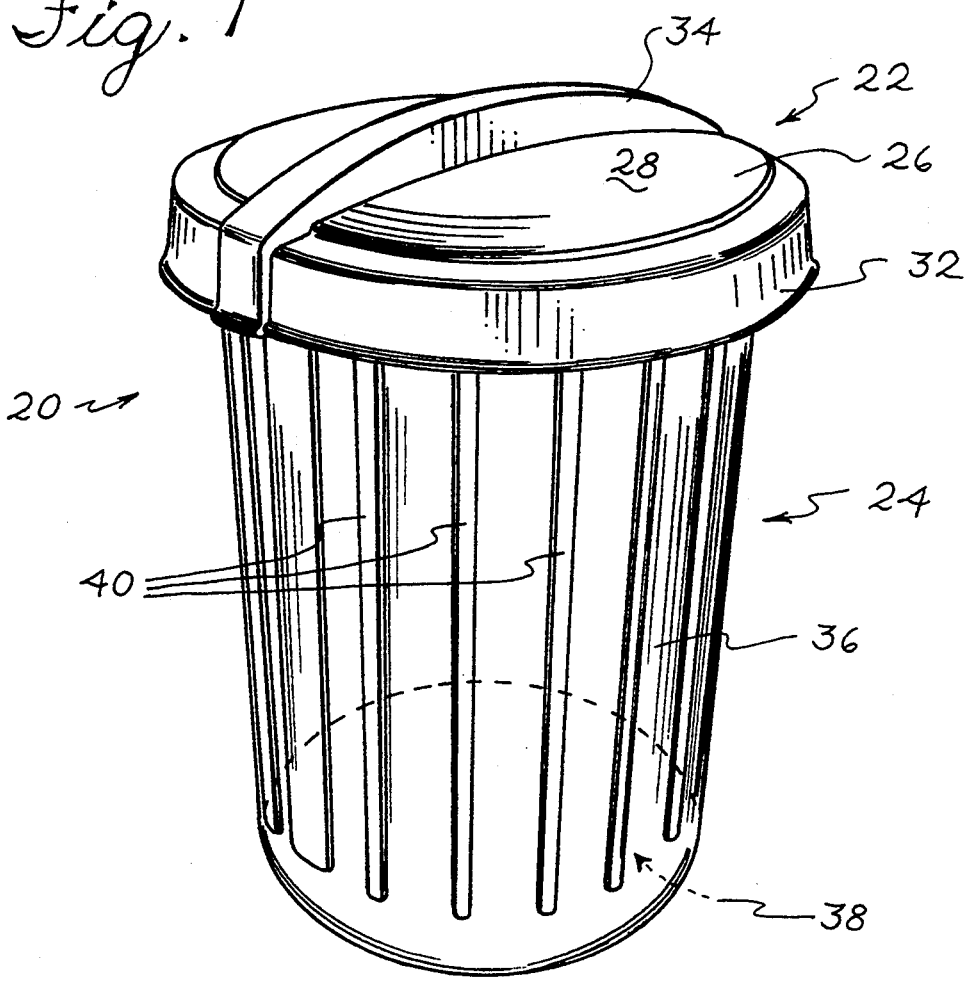
FIG. 1 is a perspective view of a refuse device according to the invention.

Referring now to the drawings in which like reference characters indicate like elements in each of the views, a refuse device 20 according to the invention has a removable cover 22 and a container 24 for containing refuse. As shown in FIG. 1, cover 22 includes a top portion 26 having an outer face 28 and an inner face 30 (shown in FIG. 3), and a circular collar 32 attached to and extending downwardly from top portion 26. Cover 22 also includes a handle 34 for grasping cover 22 to remove cover 22 from container 24 or to rotate cover 22 to secure cover 22 to container 24 or to disengage cover 22 from container 24. Preferably, cover 22 is formed from a molded plastic with handle 34 and collar 32 being integral parts of cover 22, thereby minimizing the components of refuse device 20 and reducing the manufacturing costs. Alternatively, handle 34 and collar 32 can be constructed as a separate components and attached to top portion 26 of cover 22 by conventional methods, such as rivets or bolts. In the preferred embodiment, handle 34 is centrally located on the outer face 28 of top portion 26.

Figure 2:
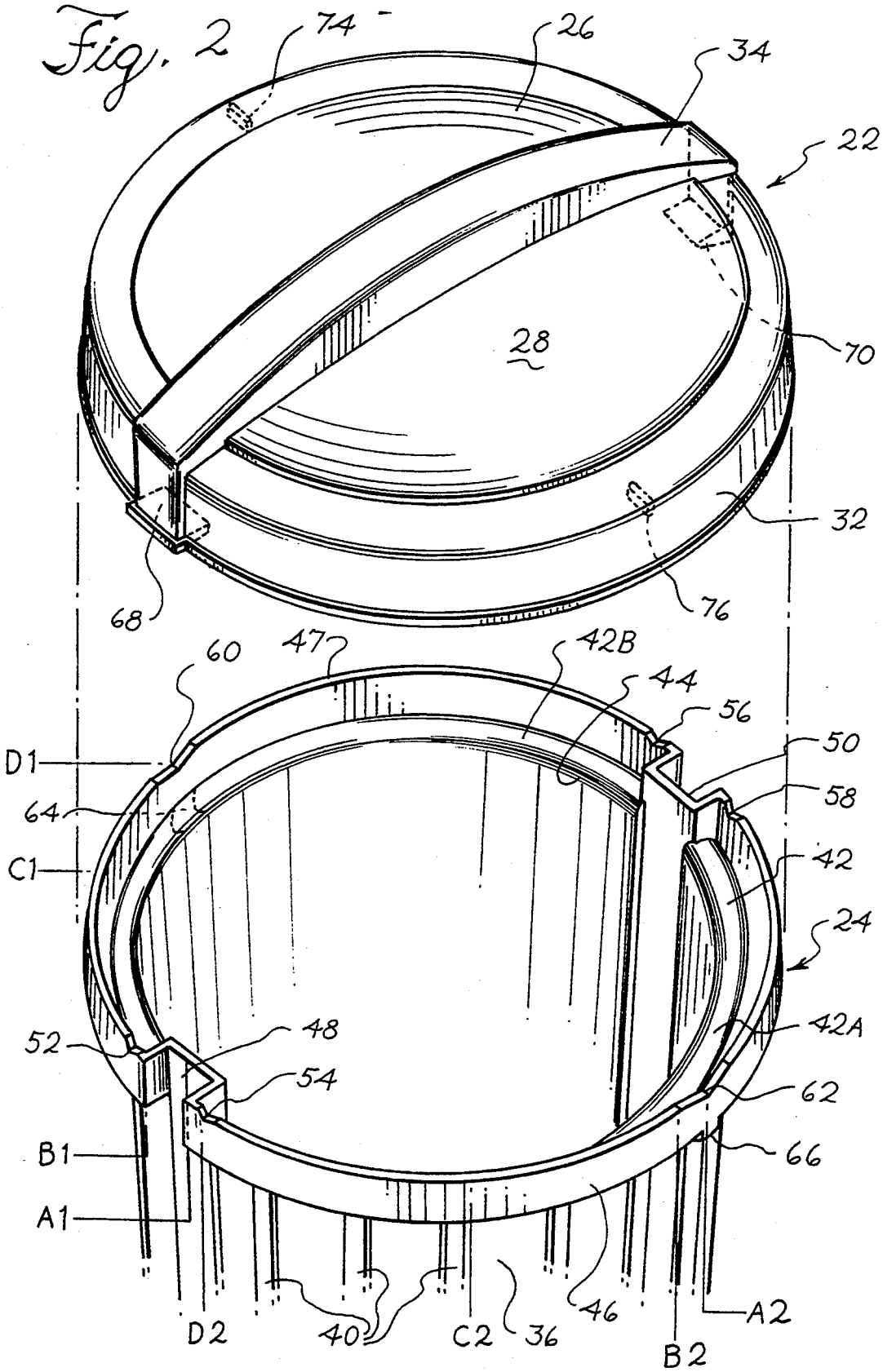
FIG. 2 is a partial perspective view of the device in FIG. 1 showing the alignment of the cover above the main container prior to placing the cover on the body.
Figure 3:
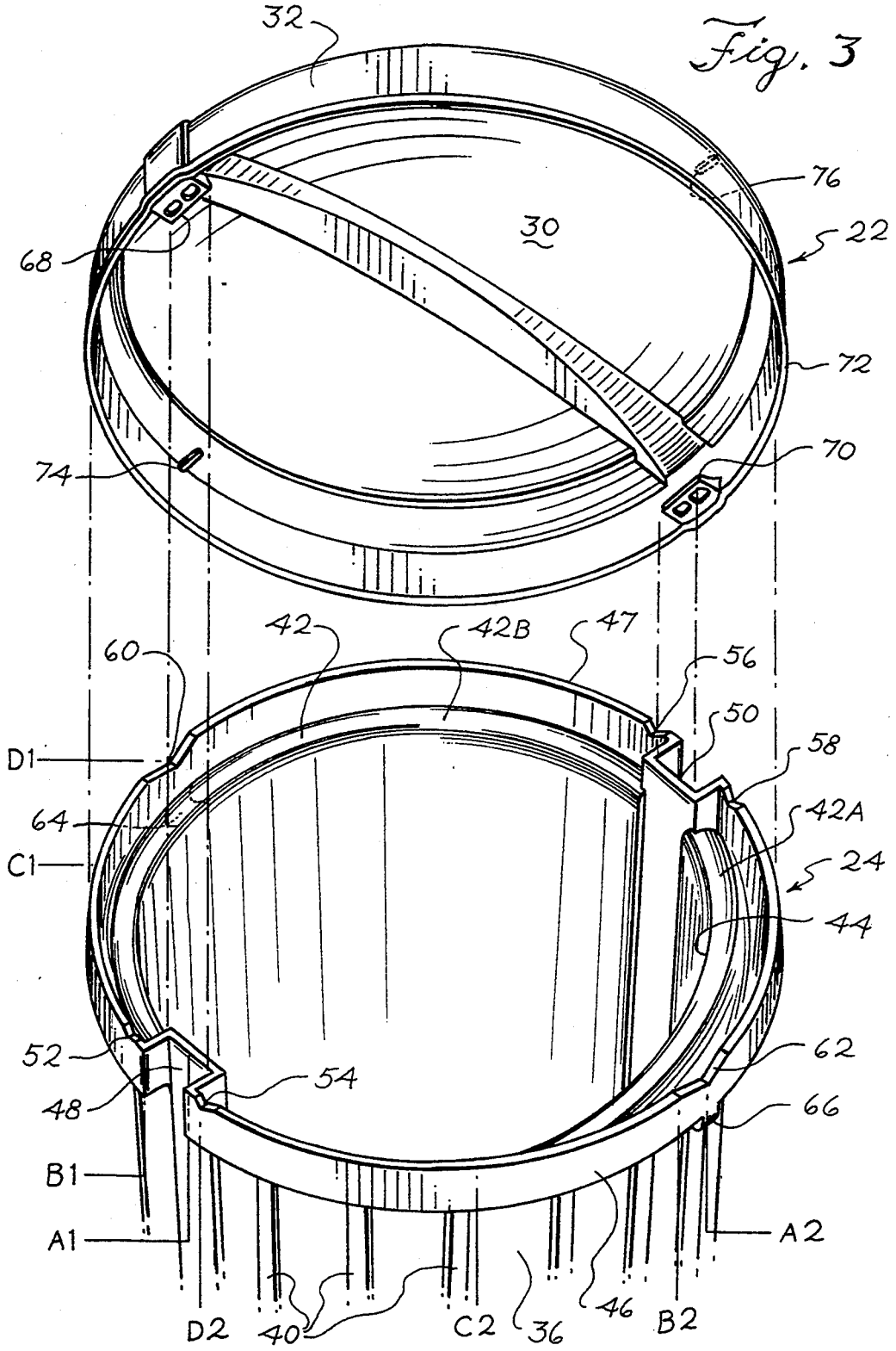
FIG. 3 is a partial perspective view of the refuse device of FIG. 1 showing the cover inverted above the main container but relatively aligned for placing the cover on the container.

Container 24 includes a sidewall 36 extending upwardly from a closed bottom 38, shown in phantom in FIG. 1. In the preferred embodiment, container 24 includes ribs 40 to increase the strength and durability of container 24. As shown in FIGS. 2 and 3, container 24 includes a rim 42 attached to and extending outwardly from the upper edge 44 of sidewall 36. A lip 46 is attached to rim 42 opposite sidewall 36 and extends upwardly from rim 42. Refuse container 24 can be readily picked up and moved by grasping container 24 under rim 42, preferably in two different locations. In addition, when cover 22 is placed on container 24, as shown in FIG. 1, collar 32 surrounds lip 46 and rim 42 thereby closing the open top of container 24. In the preferred embodiment container 24 is economically constructed from molded plastic with sidewall 36, bottom 38, ribs 40, rim 42, and lip 46 being integral parts of container 24.

Lip 46 includes two channels 48 and 50 which extend inwardly from lip 46 toward sidewall 36 and which are preferably diametrically opposite each other. Channels 48 and 50, which are the same shape and size, also divide rim 42 into two rim portions 42A and 42B. In addition, in the preferred embodiment rim portions 42A and 42B have substantially constant cross-sections throughout their entire length.

Channel 48 is flanked by two groove 52 and 54 formed in the upper edge 47 of lip 46. Similarly, two groove 56 and 58 are located in upper edge 47 on opposite sides of channel 50. Grooves 52 and 58 are diametrically opposite each other, as are groove 54 and 56. Grooves 52, 54, 56, and 58 impede the rotational movement of cover 22 when cover 22 is in the third, locked position. Consequently, groove 52, 54, 56, and 58 preferably have steep slopes. Lip 46 also includes two V-groove 60 and 62 which are spaced apart from channels 48 and 50. In the preferred embodiment, V-groove 60 is halfway between channels 48 and 50 while V-groove 62 is diametrically opposite V-groove 60 and located halfway between channels 48 and 50. In the preferred embodiment, container 24 also includes a pair of detents 64 and 66 subjacent V-grooves 60 and 62 and extending downwardly from rim 42 and lip 46.

As best seen in FIG. 3, cover 22 includes two tabs 68 and 70 attached to collar 32 and spaced apart from top portion 26. In the preferred embodiment, tabs 68 and 70 are diametrically opposite each other and are adjacent the lower edge 72 of collar 32. Tabs 68 and 70 project inwardly from collar 32. In the preferred embodiment, tabs 68 and 70 extend generally parallel to and are aligned with handle 34. Two latches 74 and 76 are located opposite each other on inner face 30 of top portion 26, adjacent collar 32. Latches 74 and 76 extend inwardly from collar 32 along inner face 30 and are spaced apart from tabs 68 and 70 along collar 32, preferably halfway between tabs 68 and 70. As explained in more detail with reference to FIGS. 4–7, when cover 22 is first placed on container 24, tabs 68 and 70 pass through channels 48 and 50 and latches 74 and 76 cooperate with V-grooves 60 and 62. In addition, when cover 22 is locked to container 24, tabs 68 and 70 cooperate with rim 42 and detents 64 and 66 and latches 74 and 76 cooperate with groove 52 and 58, respectively (or alternatively with grooves 56 and 54).

To place cover 22 on container 24, tabs 68 and 70 are first aligned with channels 48 and 50, thereby aligning latches 74 and 76 with V-grooves 60 and 62, as best seen in FIG. 2. When cover 22 is lowered onto container 24, tabs 68 and 70 are positioned within and move through channels 48 and 50.

FIGS. 4–7 are fragmentary front elevational partially cut away views of refuse device 20 showing the relative positions of cover 22 and container 24 as cover 22 is rotated clockwise relative to container 24 to move cover 22 from a first, removable position through a second, non-removable position to a third, locked position. Because in the preferred embodiment cover 22 is circular and container 24 is conical, refuse device 20 does not have a well-defined front. For the purpose of explanation, the front of refuse device 20 extends between tabs 68 and 70 and is the portion nearest the viewer.

Figure 4:
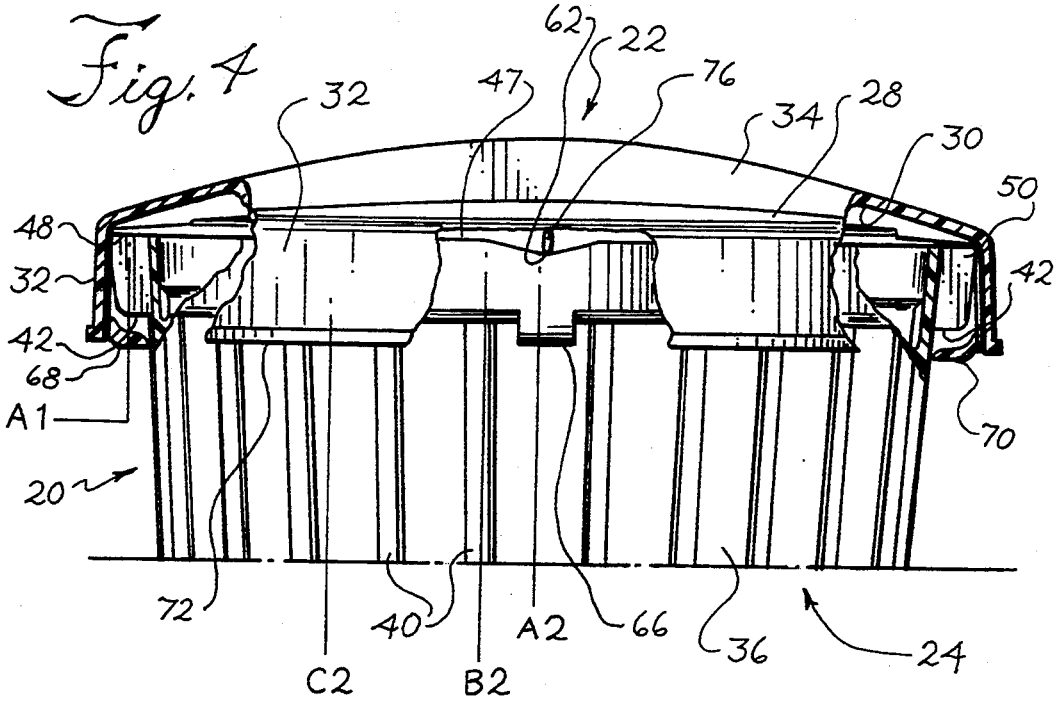
FIG. 4 is a fragmentary partially cut away front elevational view, partly in section, showing the alignment of the cover on the container when the cover is first placed on the container and the cover is easily removable from the container.

FIG. 4 shows the relative positions of cover 22 and container 24 when cover 22 is in the first, removable position, for example, when cover 22 first placed on container 24. The middle of tab 68 is aligned with A1, shown in FIGS. 2, 3, and 4, and latch 76 is aligned with A2, shown in FIGS. 2, 3 and 4. When cover 22 is in the first, removable position shown in FIG. 4, tabs 68 and 70 are positioned directly below channels 48 and 50. Because tabs 68 and 70 extend inwardly from collar 32, in other relative positions lip 46 and rim 42 obstruct the vertical movement of tabs 68 and 70. Channels 48 and 50 thus permit tabs 68 and 70 to pass through lip 46 and rim 42 when cover 22 is in the first, removable position. Consequently, in the first position shown in FIG. 4, cover 22 can be readily placed on and removed from container 24. In addition, when tabs 68 and 70 have passed entirely through channels 48 and 50, as shown in FIG. 4, tabs 68 and 70 are positioned below rim 42 and are separated from rim 42 by a small gap because latches 74 and 76 are positioned at the nadir of V-grooves 60 and 62. Tabs 68 and 70 therefore can be easily moved past channels 48 and 50, for example, by rotating cover 22 clockwise or counterclockwise relative to container 24. The initial positioning of latches 74 and 76 at the nadirs of V-grooves 60 and 62 thus lowers tabs 68 and 70 slightly below rim 42 and thereby facilitates rotating cover 22 to its locked position.

Figure 5:
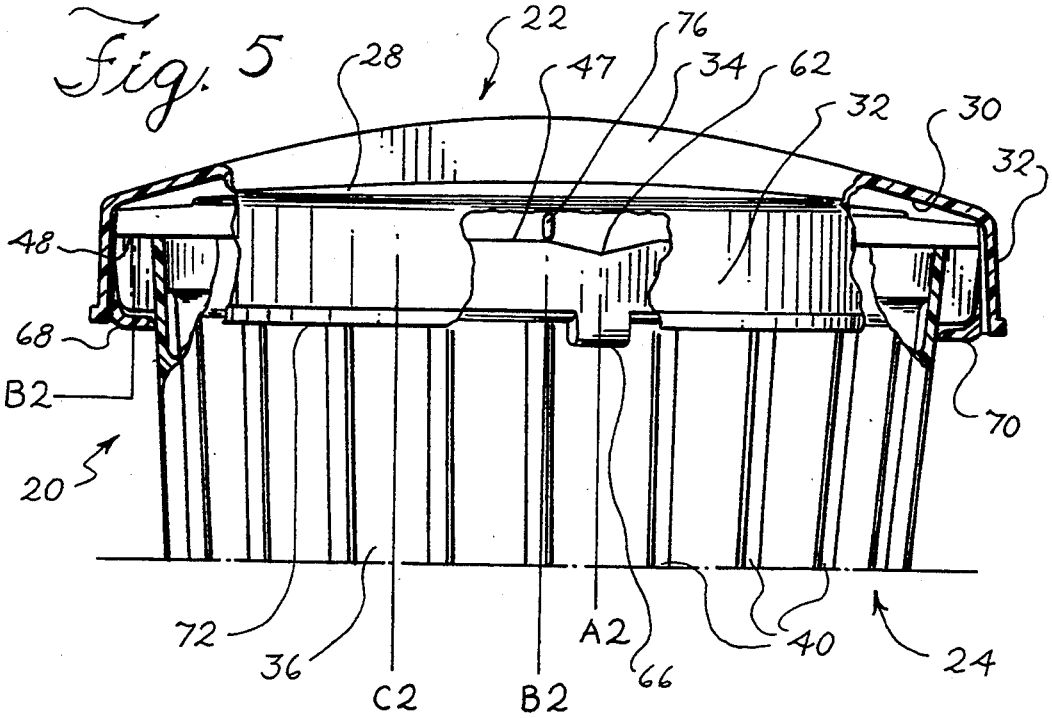
FIG. 5 is a fragmentary partially cut away front elevational view, partly in section, showing the alignment of the cover and the container after the cover has been rotated slightly clockwise relative to its placement in FIG. 6.

FIG. 5 shows the relative positions of cover 22 and container 24 after cover 22 has been rotated slightly clockwise to a non-removable position. Thus, as shown in FIG. 5, cover 22 has been rotated slightly clockwise relative to container 24 until the middle of tab 68 is aligned with B1, shown in FIGS. 2, 3, 4 and 5 and latch 76 is aligned with B2, shown in FIGS. 2, 3, 4, and 5. At this point, tabs 68 and 70 are partially below rim 42. Latch 76 is still positioned within groove 62. However, latch 76 is no longer at the nadir of V-groove 62, but instead is positioned towards the top of one of the sloped portions of V-groove 62. Similarly, latch 74 (not shown) is positioned near the top of one of the sloped portions of V-groove 60 (not shown). As latches 74 and 76 move out of V-grooves 60 and 62, cover 22 is raised slightly relative to container 24 thus bringing tabs 68 and 70 closer to rim 42.

Figure 6:
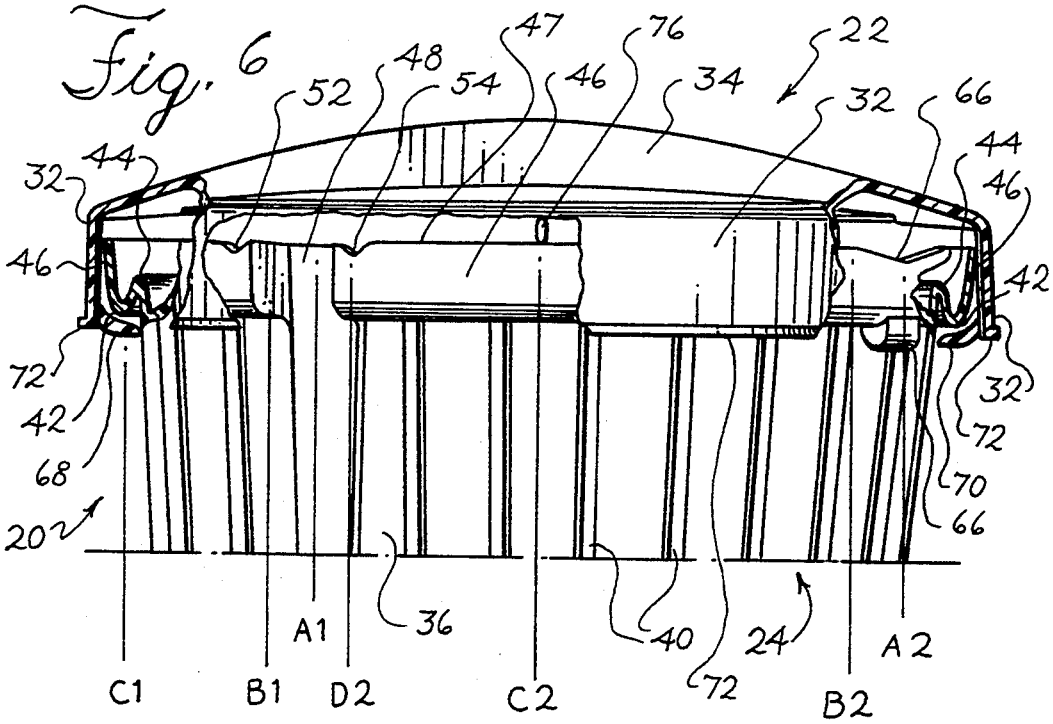
FIG. 6 is a fragmentary partially cut away front elevational view, partly in section, showing the alignment of the cover and the container after the cover has been further rotated clockwise relative to its placement in FIG. 7, when the cover cannot be easily lifted and removed from the container.

FIG. 6 shows the relative position of cover 22 and container 24 after cover 22 has been further rotated clockwise to a non-removable position. In FIG. 6, cover 22 has been further rotated clockwise until the middle of tab 68 is aligned with C1, shown in FIGS. 2, 3, 4, 5, and 6 and latch 76 is aligned with C2, shown in FIGS. 2, 3, 4, 5, and 6. Both tabs 68 and 70 are outside of channels 48 and 50 and are now positioned below rim 42. In addition, latch 76 is now positioned along upper edge 47 of lip 46, as is latch 74 (not shown). Because latch 74 (not shown) and latch 76 are positioned on upper edge 47, tabs 68 and 70 are now closer to rim 42 than when latches 74 and 76 are positioned within V-grooves 60 and 62. The close proximity of tabs 68 and 70 to rim 42 helps to prevent accidental removal of cover 22. For example, if refuse device 20 falls or is knocked over, the close proximity of tabs 68 and 70 to rim 42 helps to prevent cover 22 from being rotated on container 24. However, when device 20 is in an upright position the gap which separates tabs 68 and 70 from rim 42 is sufficient to permit a user to deliberately rotate cover 22 on container 24 to open refuse device 20 or to move cover 22 to its locked position.

In the positions shown in FIGS. 5 and 6, cover 22 is secured to container 24 and cannot be lifted and removed from container 24 because rim 42 obstructs the upward movement of tabs 68 and 70. In FIG. 5, tabs 68 and 70 are at least partially positioned below rim 22. Therefore, in the position shown in FIG. 5, cover 22 cannot be removed from container 24 by simply lifting cover 22 because rim 42 obstructs the upward motion of tabs 68 and 70. Similarly, in the position shown in FIG. 6, tabs 68 and 70 are positioned fully below rim 42 which therefore obstructs the upward motion of tabs 68 and 70 and of cover 22. Consequently, cover 22 is in the second, non-removable position whenever tabs 68 and 70 are at least partially below rim 42 and latches 74 and 76 are positioned along edge 47 outside of grooves 52–62.

Figure 7:
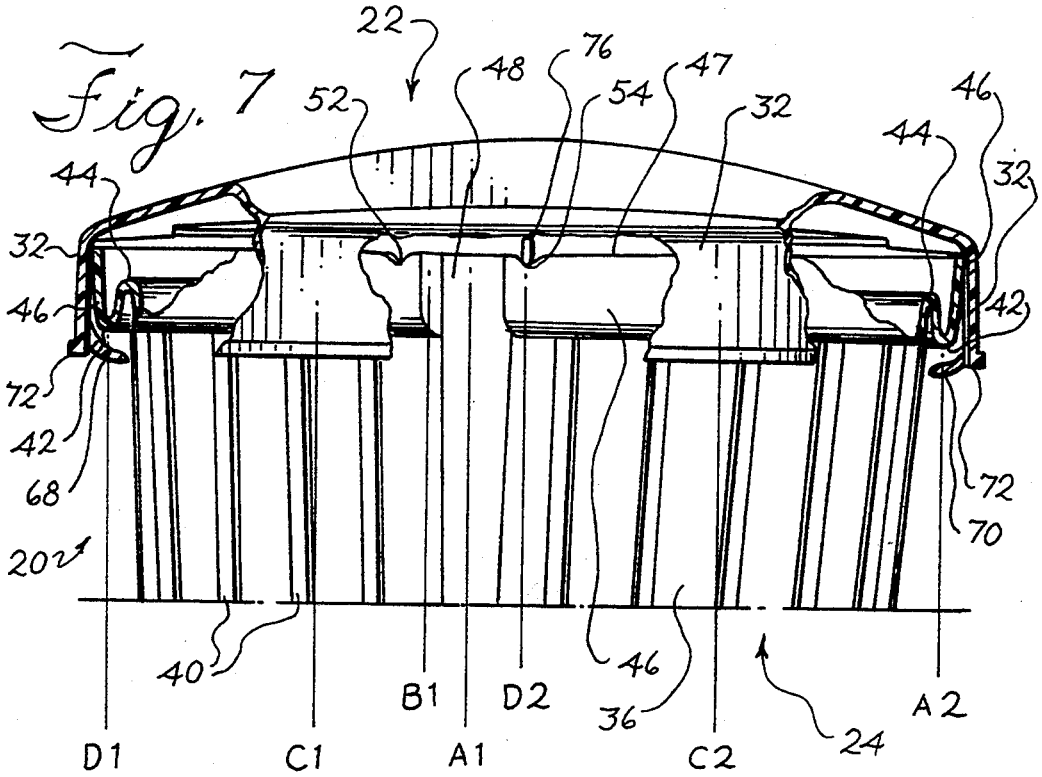
FIG. 7 is a fragmentary partially cut away front elevational view, partly in section, showing the alignment of the cover and the container after the cover has been further rotated clockwise relative to its placement in FIG. 8., when the cover is locked to the container and cannot be lifted and removed.

FIG. 7 shows the relative positions of cover 22 and container 24 after cover 22 has been further rotated clockwise to the third, locked position. As shown in FIG. 7, cover 22 has been rotated clockwise until tab 68 is aligned with D1, shown in FIGS. 2, 3, and 7 and latch 76 is aligned with D2, shown in FIGS. 2, 3, and 7. In this configuration, grooves 52–58 limit the rotational movement of cover 22 on container 24. For example, as shown in FIG. 7, latch 76 is positioned within groove 54. Similarly, latch 74 (not shown) is positioned within groove 56. Because of the position of latches 76 and 74 within grooves 54 and 56, cover 22 cannot be rotated on container 24 unless cover 22 is lifted to remove latches 76 and 74 from within grooves 54 and 56. In addition, cover 22 cannot be removed from container 24 by merely lifting cover 22 because rim 42 obstructs the upward movement of tabs 68 and 70. Consequently, cover 22 is locked to container 24 because cover 22 resists rotation on container 24 and cannot be removed from container 24 by merely lifting cover 22.

Figure 8:
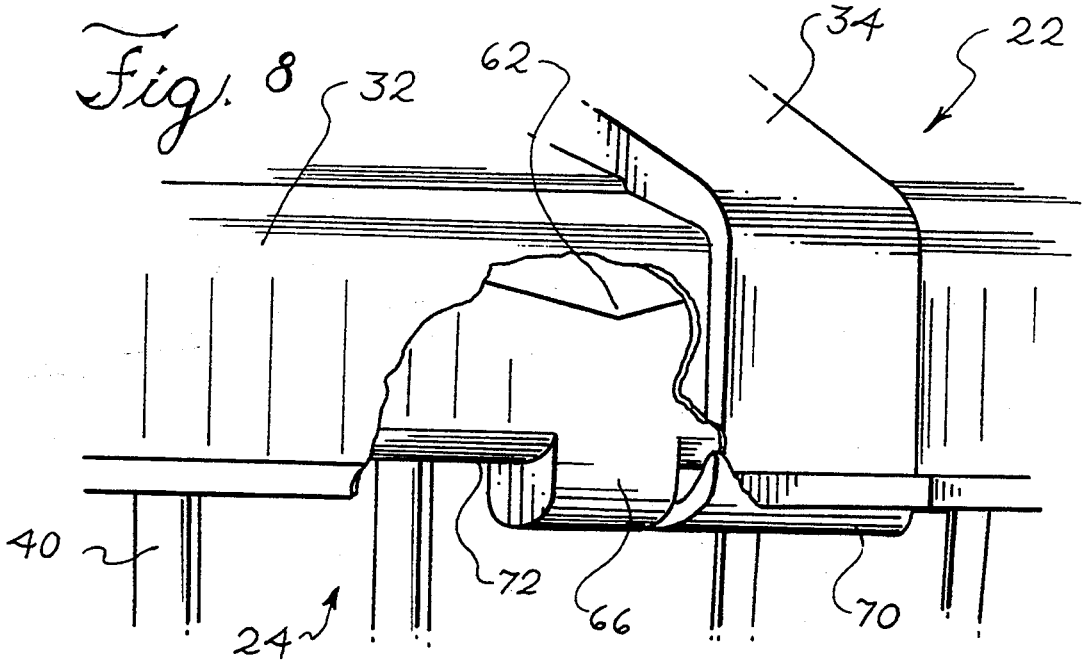
FIG. 8 is a enlarged perspective view of a portion of the refuse device in FIG. 7 showing the placement of a tab on the cover relative to a detent on the container when the cover is locked to the container and cannot be lifted and removed.

FIG. 8 is an fragmentary enlarged view of cover 22 and container 24 showing the positioning of tab 70 and detent 66 when cover 22 is in the locked position. When cover 22 is rotated to the locked position shown in FIG. 7, detent 66, which underlies V-groove 62 is adjacent tab 70 and detent 64 (not shown) below V-groove 60 (not shown) is adjacent tab 68 (not shown). Because detents 64 and 66 extend downwardly from the lower edge 72 of lip 46, detents 64 and 66 obstruct the movement of tabs 68 and 70 past V-grooves 60 and 62. Consequently, detents 64 and 66 stop the rotational movement of cover 22 past the locked position shown in FIG. 7 thereby facilitating placement of latches 74 and 76 in grooves 56 and 54. Detents 64 and 66 thus ensure proper placement of cover 22 in the locked position.

In use, device 20 provides a user-friendly, animal and child-proof refuse device. Cover 22 is placed on container 24 by first aligning tabs 68 and 70 with channels 48 and 50. Thereafter, lowering cover 22 onto container 24 positions tabs 68 and 70 directly below channels 48 and 50. After placing cover 22 on container 24 in this fashion, a user then rotates cover 22 either clockwise or counterclockwise relative to container 24 so that tabs 68 and 70 move from just below channels 48 and 50 to positions in which tabs 68 and 70 are at least partially subjacent rim 42. As noted earlier, in this second configuration, cover 22 is secured to container 24 and can not be lifted and removed from container 24. Cover 22 can then be further rotated in the same direction to place cover 22 in the third position in which cover 22 is locked to container 24. In this configuration, latch 74 rests within either groove 52 or groove 56 while latch 76 rests within either groove 54 or groove 58, depending on the direction in which cover 22 was initially rotated. Cover 22 is thus locked to container 24 and cannot be easily rotated on container 24 due to the interaction of latches 74 and 76 with two of grooves 52–58. In addition, due to the interaction of rim 42 with tabs 68 and 70, cover 22 cannot be removed from container 24 by merely lifting cover 22.

To unlock and remove cover 22 from container 24, the user first lifts up on cover 22, for example, by lifting up on handle 34, to remove latches 74 and 76 from grooves 52–58. Then, the user rotates cover 22 either clockwise or counterclockwise (depending upon previous user preference) until tabs 68 and 70 are aligned with and positioned directly below channels 48 and 50. Further lifting of cover 22 then causes tabs 68 and 70 to pass through channels 48 and 50, respectively, thereby enabling cover 22 to be removed from container 24.

Refuse device 20 provides many advantages over the prior art. Cover 22 is easily locked to container 24 by simply rotating cover 22 to a locked position. Moreover, because refuse device 20 is symmetrical, there are a variety of relative configurations of cover 22 and container 24 which permit locking of cover 22 to container 24. Thus, for example, as noted earlier, cover 22 can be initially aligned with container 24 by placing tab 68 in channel 48 and tab 70 in channel 50, as shown in FIGS. 1 and 4. Alternatively, cover 22 can be initially aligned with container 24 by placing tab 68 in channel 50 and tab 70 in channel 48. Additionally, cover 22 may be rotated either clockwise or counterclockwise relative to container 24 to place cover 22 in the locked configuration. For example, if cover 22 is positioned initially positioned as shown in FIGS. 4–7, rotating cover 22 clockwise relative to container 24 places latch 76 in groove 54 and latch 74 in groove 56 when cover 22 is locked to container 24. Alternatively, given the same initial configuration, rotating cover 22 counterclockwise relative to container 24 places latch 76 in groove 58 and latch 74 in groove 52 when cover 22 is locked to container 24. Thus, there are a variety of orientations and movements which can be used to lock cover 22 to container 24, making refuse device 20 easy to use. In addition, because handle 34 is used not only to place cover 22 on and remove cover 22 from container 24 but also to rotate cover 22 to a locked position, cover 22 can be unlocked and removed from container 24 in a minimum of steps which, for some people, can be accomplished by using only one hand.

However, even though cover 22 can be easily operated by adults, cover 22 cannot be easily manipulated by either small children or animals. As explained with reference to FIG. 7, once in a locked position cover 22 cannot be easily rotated on container 24 because latches 74 and 76 rest in two of deep grooves 52–58. To unlock and remove cover 22 from container 24, cover 22 must be raised slightly, for example, by lifting up on handle 34. Small children and animals generally will not be able to raise cover 22 to unlock it from container 24. However, even if a small child or animal could unlock cover 22 by raising it slightly, the child or animal will not have succeeded in opening device 20 because cover 22 remains firmly attached to container 24 until cover 22 is rotated sufficiently to place tabs 68 and 70 directly below channels 48 and 50. Refuse container is therefore both animal and child-proof.

Cover 22 is also secure from accidental disengagement which can happen, for example, if device 20 falls or is knocked over. First, cover 22 remains locked to container 24 as long as latches 74 and 76 are positioned within two of grooves 52–58. Therefore, if latches 74 and 76 remain in two of grooves 52–58 when device 20 falls or is knocked over, cover 22 will remain locked to container 24. Moreover, even if latches 74 and 76 become disengaged from their grooves, unless cover 22 is rotated enough to place tabs 68 and 70 directly below channels 48 and 50, cover 22 will remain firmly attached to container 24 because rim 42 prevents the upward movement of tabs 68 and 70.

In addition, because the locking components of device 20, such as tabs 68 and 70, latches 74 and 76, channels 48 and 50, and grooves 52–58, are permanently attached to cover 22 and container 24, the locking components cannot become disengaged from device 20 and lost or misplaced. Furthermore, because cover 22 is easily locked to container 24 by simply rotating cover 22 to a locked position, cover 22 and container 24 need not to be constructed from resilient materials. Consequently, device 20 can be made from a variety of materials include both rigid and deformable material. And since nether cover 22 nor container 24 is deformed when cover 22 is locked to or unlocked from container 24, device 20 can be used in extreme climates.

In the preferred embodiment shown in FIGS. 1–7, device 20 includes all of the previously described locking components, including tabs 68 and 70 and latches 74 and 76 on cover 22 and channels 48 and 50 and grooves 52–62 and detends 64 and 66 in lip 46 of container 24. However, device 20 can be constructed with fewer locking components. For example, device 20 can be constructed to include only one latch, for example, latch 74. In this embodiment cover 22 is locked to container 24 when latch 74 is positioned within one of grooves 52–58. The locked positions of cover 22 are somewhat less secure than the locked positions of cover 22 in the preferred embodiment shown in FIGS. 1–7. This second embodiment nonetheless satisfies all the objectives of the invention. In a third embodiment, cover 22 can be constructed to include one latch, for example latch 74, and container 24 can be constructed to include only two grooves, for example, grooves 52 and 56. In this embodiment cover 22 is locked to container 24 by placing latch 74 in either groove 52 or groove 56. This embodiment can be further refined by providing a third groove, such as groove 60, intermediate grooves 52 and 56. Like the second embodiment, the locked positions of cover 22 in the third embodiment are somewhat less secure than the locked positions of cover 22 in the preferred embodiment shown in FIGS. 1–7. The third embodiment still satisfies all the objectives of the invention. In a fourth embodiment, cover 22 can be constructed to include only tabs 68 and 70 but not latches 74 and 76. In the same embodiment, container 24 can be constructed to include channels 48 and 50 but not grooves 52–62 in this embodiment, cover 22 cannot be fully locked to container 24 because at all times cover 22 can be easily rotated on container 24. However, when cover 22 is rotated sufficiently on container 24 to place tabs 68 and 70 at least partially below rim 42, cover 22 is secured to container 24 because rim 42 obstructs the upward movement of tabs 68 and 70. The fourth embodiment thus also satisfies all the objectives of the invention.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. A device for containing refuse, comprising:

a cover having a top portion, a downwardly depending circular collar attached to the top portion, a first tab attached to the collar, spaced apart from the top portion, and extending inwardly from the collar, and a second tab diametrically opposite the first tab and attached to the collar, spaced apart from the top portion, and extending inwardly from the collar;

a container having a sidewall terminating in an upper edge, a closed bottom attached to the sidewall opposite the upper edge, an outwardly extending rim attached to the upper edge of the sidewall, and an upwardly extending lip attached to the rim opposite the sidewall upper edge, the lip including a first channel extending inwardly through the lip and the rim toward the sidewall and a second channel diametrically opposite the first channel and extending inwardly through the lip and the rim toward the sidewall, the first and second channels being configured to permit the first and second tabs to pass through the lip and the rim;

wherein the cover is rotatably moveable between a first, removable position and a second, non-removable position in which the cover is rotatable on the container, the first tab being aligned with and positioned below one of the first and second channels and the second tab being aligned with and positioned below the second of the first and second channels when the cover is in the first position, and the first tab being positioned below a portion of the rim and the second tab being positioned below a portion of the rim opposite the first tab when the cover is in the second position.

2. The device of claim 1 wherein the top portion of the cover further comprises an outer face, an inner face, and a latch located on the inner face adjacent the collar, spaced apart from the first and second tabs, and extending radially inwardly along the inner face;

wherein the container further comprises first and second grooves located along an upper edge of the lip, the first groove being located adjacent the first channel and the second groove being located adjacent the second channel and between the second channel and the first groove; and wherein the cover is further rotatably moveable to a third, locked position in which the cover resists rotation on the container, the latch being positioned along the upper edge of the lip when the cover is in the second position and the latch being positioned within one of the first and second grooves when the cover is in the third position.

3. The device of claim 2 wherein the container further comprises a third groove spaced apart from the first and second grooves and located intermediate the first and second grooves and wherein the latch is positioned within the third groove when the cover is in the first position.

4. The device of claim 3 wherein the container further comprises a detent subjacent the third groove, wherein the detent is adjacent one of the first and second tabs when the cover is in the third position.

5. The device of claim 3 wherein the container further comprises fourth and fifth grooves located along the upper edge of the lip, the fourth groove being located adjacent the first channel on a side of the first channel opposite the first groove, the fifth groove being located adjacent the second channel on a side of the second channel opposite the second groove; and wherein the latch is positioned within one of the first, second, fourth, and fifth grooves when the cover is in the third position.

6. The device of claim 5 wherein the container further comprises a sixth groove intermediate the fourth and fifth grooves and diametrically opposite the third groove and wherein the latch is positioned within one of the third and sixth grooves when the cover is in the first position.

7. The device of claim 6 wherein the container further comprises first and second detents, the first detent being positioned subjacent the third groove, the second detent being positioned subjacent the sixth groove, wherein the first tab is adjacent one of the first and second detents and the second tab is adjacent the other of the first and second detents when the cover is in the third position.

8. The device of claim 6 wherein the cover further comprises a second latch located on the inner face adjacent a second portion of the collar opposite the first latch and extending radially inwardly along the inner face; and wherein the second latch is positioned within the other of the third and sixth grooves when the cover is in the first position, the second latch is positioned along the upper edge of the lip when the cover is in the second position, and the second latch is positioned within one of the first, second, fourth, and fifth grooves diametrically opposite the first latch when the cover is in the third position.

9. The device of claim 8 wherein the container further comprises first and second detents, the first detent positioned subadjacent the third groove, the second detent positioned subadjacent the sixth groove, wherein the first tab is adjacent one of the first and second detents and the second tab is adjacent the other of the first and second detents when the cover is in the third position.

10. A device for containing refuse, comprising:

a cover having a top portion including an inner face and an outer face, a downwardly depending circular collar attached to the top portion, a first tab attached to the collar, spaced-apart from the top portion, and extending inwardly from the collar, a second tab diametrically opposite the first tab and attached to the collar, spaced apart from the top portion and extending inwardly from the collar, and a latch located on the inner face adjacent the collar, spaced apart from the first and second tabs, and extending radially inwardly along the inner face;

a container having a sidewall terminating in an upper edge, a closed bottom attached to the sidewall opposite the upper edge, an outwardly extending rim portion attached to the upper edge of the sidewall, and an upwardly extending lip attached to the rim opposite the sidewall upper edge, the lip including a first channel extending inwardly through the lip and the rim toward the sidewall, a second channel diametrically opposite the first channel and extending inwardly through the lip and the rim toward the sidewall, the first and second channels being configured to permit the first and second tabs to pass through the lip and the rim, and first, second, third, and fourth grooves located along an upper edge of the lip, the first groove being located adjacent the first channel, the second groove being located adjacent the second channel and between the second channel and the first groove, the third groove being located adjacent the first channel on a side of the first channel opposite the first groove and the fourth groove being located adjacent the second channel on a side of the second channel opposite the second groove;

wherein the cover is rotatably moveable between a first, removable position, a second, non-removable position in which the cover is rotatable on the container, and a third, locked position in which the cover resists rotation on the container, the first tab being aligned with and positioned below one of the first and second channels and the second tab being aligned with and positioned below the other of the first and second channels when the cover is in the first position, the first tab being positioned below a portion of the rim, the second tab being positioned below a portion of the rim opposite the first tab, and the latch being positioned along the upper edge of the lip when the cover is in the second position, and the latch being positioned within one of the first, second, third, and fourth grooves when the cover is in the third position.

11. The device of claim 10 wherein the cover further comprises a second latch located on the inner face adjacent the collar and opposite the first latch and extending radially inwardly along the inner face; and wherein the second latch is positioned within one of the first, second, third and fourth grooves opposite the groove within which the first latch is located when the cover is in the third position.

12. The device of claim 11 wherein the container further comprises fifth and sixth grooves located along the upper edge of the lip, the fifth groove intermediate the first and second grooves, the sixth groove intermediate the third and fourth grooves and diametrically opposite the fifth groove; and wherein the first latch is positioned within one of the fifth and sixth grooves and the second latch is positioned within the other of the fifth and sixth grooves when the cover is in the first position.

13. The device of claim 12 wherein the container further comprises first and second detents, the first detent positioned subadjacent the fifth groove, the second detent positioned subadjacent the sixth groove, wherein the first tab is subadjacent one of the first and second detents and the second tab is adjacent the other of the first and second detents when the cover is in the third position.

* * * * *